United States Patent [19]

Stefaniak

[11] 4,361,159

[45] Nov. 30, 1982

[54] HAIR ROLLER

[75] Inventor: Phillip S. Stefaniak, Evanston, Ill.

[73] Assignee: Helene Curtis Industries, Inc., Chicago, Ill.

[21] Appl. No.: 184,252

[22] Filed: Sep. 15, 1980

[51] Int. Cl.[3] ..... A45D 2/08

[52] U.S. Cl. ..... 132/41 R; 132/33 R

[58] Field of Search ..... 132/33 R, 39, 40, 41 R, 132/41 B, 46 R, 46 A, 52

[56] References Cited

U.S. PATENT DOCUMENTS

| | | | |
|---|---|---|---|
| 1,068,244 | 7/1913 | Jacobsen | 132/52 |
| 2,031,484 | 2/1936 | Inderrante | 132/52 |
| 2,648,339 | 8/1953 | Swenson et al. | 132/33 R |
| 2,763,270 | 9/1956 | Carey | 132/40 |
| 3,289,680 | 12/1966 | Kubiak | 132/40 |
| 3,417,760 | 12/1968 | Silver | 132/40 |
| 3,495,602 | 2/1970 | Pomaro | 132/40 |
| 3,533,418 | 10/1970 | Mestral | 132/40 |
| 3,559,658 | 2/1971 | Genest et al. | 132/33 R |
| 3,568,687 | 3/1971 | Ciccone | 132/46 A |
| 3,610,878 | 10/1971 | Thomas et al. | 132/33 R |
| 3,689,736 | 9/1972 | Meyer | 132/33 R |
| 3,696,820 | 10/1972 | Lara | 132/40 |
| 3,776,243 | 12/1973 | Oshita et al. | 132/33 R |
| 3,814,113 | 6/1974 | Morane et al. | 132/36 R |
| 4,202,360 | 5/1980 | Walter | 132/40 |
| 4,236,540 | 12/1980 | Takagi et al. | 132/40 |

FOREIGN PATENT DOCUMENTS

| | | | |
|---|---|---|---|
| 38490 | 3/1931 | France | 132/40 |
| 52-51276 | 4/1977 | Japan | 132/33 R |

*Primary Examiner*—Paul J. Hirsch

*Attorney, Agent, or Firm*—Dressler, Goldsmith, Shore, Sutker & Milnamow, Ltd.

[57] ABSTRACT

A hair roller is provided that comprises a tubular body defining an outer surface for receiving hair to be wound thereon. The outer surface is free of projections or depressions exceeding 0.010 inches in height or depth. The outer surface of the tubular body is formed of a resilient, elastomeric, compressible, and non-porous material having a Shore durometer A hardness of between about 20 and about 65. The outer surface also has a static coefficient of friction greater than about 50, measured at ambient temperature against dry hardwood on the James machine in accordance with ANSI/ASTM F 489-77, whereby hair will readily grip the outer surface to facilitate winding hair about the hair roller.

2 Claims, 6 Drawing Figures

FIG. 1
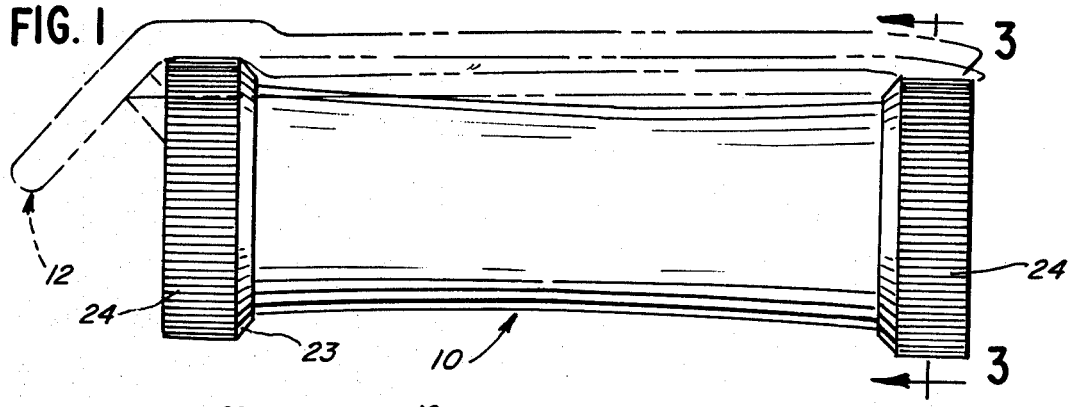
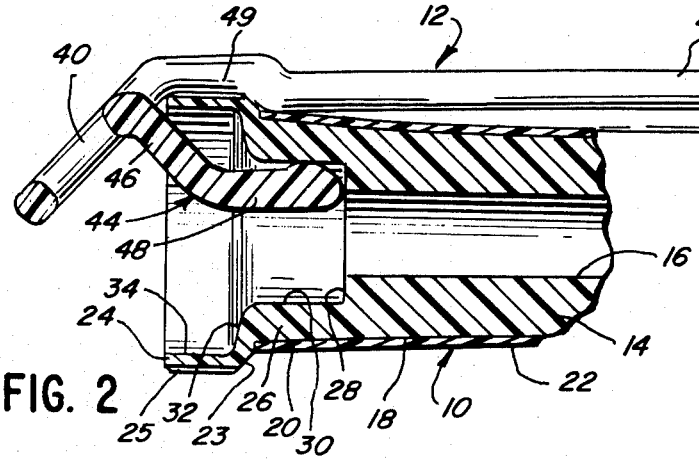
FIG. 2
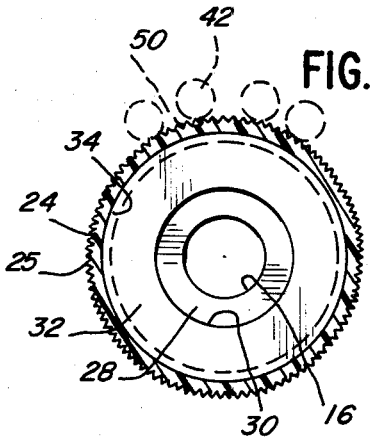
FIG. 3
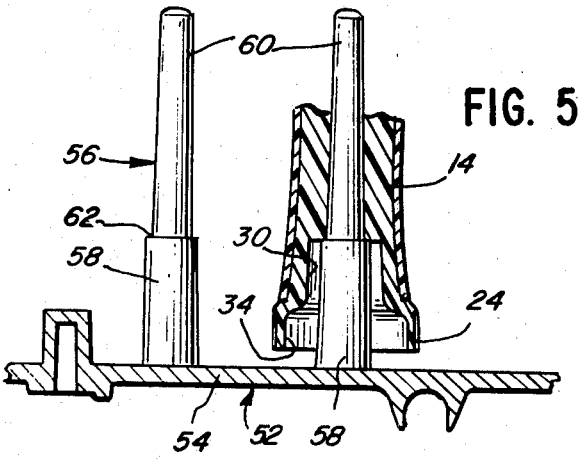
FIG. 5
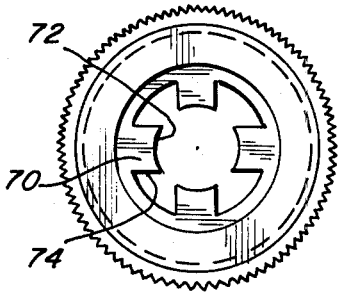
FIG. 4
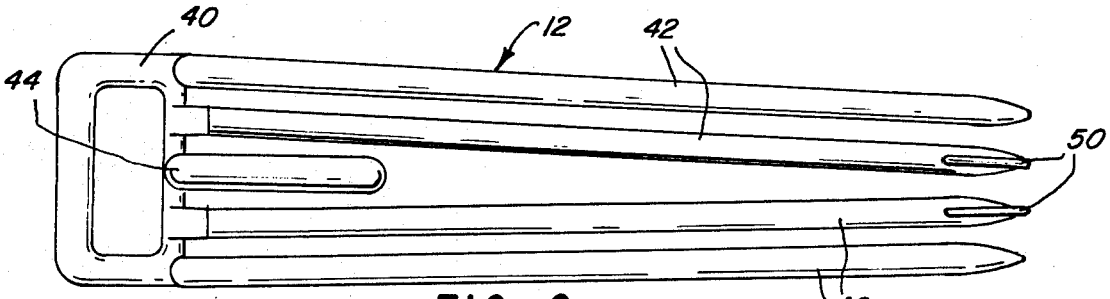
FIG. 6

HAIR ROLLER

FIELD OF THE INVENTION

The present invention relates to hair rollers and, more particularly, to hair rollers in which heat may be applied to hair that is wound around the roller to effect temporary or permanent waving to the hair.

BACKGROUND OF THE INVENTION

Hair rollers of various types are commonly used to create permanent or temporary waves in hair. The hair on the rollers may be either wet or dry; and the rollers may be heated, internally or externally, or not at all. For permanent waves the hair is wetted with a solution or lotion which alters the molecular structure of the hair. For temporary waves, the hair may be dry, or may be wetted with water or with a lotion which produces a surface coating on the hair.

Prior to the instant invention, there was no single roller type which was capable of being used effectively for all of the above applications.

One common use of hair rollers is in heat-assisted waving in which the roller is preheated before hair is wound around it and in which the roller transmits its heat to the hair to effect or to assist in the effecting of the desired wave.

Hair rollers in use today for heat-assisted waving are usually essentially cylindrical with external tongues, or fins, extending at right angles to the cylindrical surface so that the fins can catch a strand of hair at the start of the winding process and thereby facilitate the winding. An example of this type of hair winder is U.S. Pat. No. 3,706,315 to Johansen. It is a disadvantage of the fins, or tongues, that they leave marks on the finished hair coiffure.

Other hair rollers have been devised which have outer pads that are porous and compressible and which do not include fins or tongues. For example, U.S. Pat. No. 3,200,826 to Solomon discloses a hair roller having a porous material of sponge-like form, such as foam rubber, polyurethane sponge, or other synthetic, or resinous, or plastic sponge. U.S. Pat. No. 3,759,271 to Caruso discloses an outer pad that is preferably a foam polymeric plastic, such as foam polystyrene or foam polyurethane.

The hair rollers described by both of the aforementioned patents are disadvantageous for heat-assisted waving because a foam covered roller has insufficient mass for holding an adequate amount of heat for maximum effectiveness in waving the hair. Also, a foam material, when dry, will wick waving solution away from the hair, resulting in uneven distribution of solution on the hair. Conversely, if the foam material is saturated with solution, more solution than is needed would be used on the hair, which is wasteful. Furthermore, the Caruso patent requires a porous pad material since the steam must pass through the porous pad in order to contact the hair.

Hair rollers have also been used to form permanent waves in the hair without using added heat ("cold waving"). The hair is wrapped on conventional rods that have a relatively small diameter so that springiness will be imparted to the hair. Rubber bands are used to retain the hair on the rods. Permanent waving lotion is applied to the hair, allowed to change the molecular structure of the hair, then neutralized, rinsed and rewrapped on to larger rollers. The hair dries while wrapped on the larger rollers either in ambient air or under a heating device, such as a hair dryer or heat lamp.

There are several disadvantages to using conventional permanent wave rods in cold waving. The hair cannot be dried on the relatively small diameter rollers because the rubber bands would leave marks, in the form of identations, on the hair. The hair cannot be wrapped on large diameter hair rollers initially because a smaller diameter is preferred for the purpose of imparting more springiness to the hair, and because large diameter hair rollers and their associated fasteners, prior to this invention, generally were not impervious to the waving lotion that is applied to the hair. Still another disadvantage of using conventional permanent wave rods is that the wrapping of small diameter rods is generally ineffective with long hair in excess of shoulder length, so that it can be used only by persons with relatively short hair.

Prior to the present invention hair rollers, or curlers have been disclosed which use a resilient material for the body of the hairs roller, such as U.S. Pat. No. 2,218,082 to Caldora and U.S. Pat. No. 2,179,525 to Solomon. The resiliency of the material in the Caldora hair curler is for the purpose of enabling a clamp to be forced over ribs in the reduced diameter portion of the mandrel and is therefore sufficient only to permit inward deflection of the ribs. Likewise, the material used in the curler disclosed in the Solomon patent is flexible so that a pair of lips at one end of the roller can be separated from one another and subsequently closed about the hair holding slot in the curler.

SUMMARY OF THE INVENTION

The foregoing disadvantages of the prior art are overcome in accordance with the present invention in which a hair roller is provided that comprises a tubular body defining an outer surface for receiving hair to be wound thereon. The outer surface is free of projections or depressions exceeding 0.010 inches (10 mls) in height or depth.

The outer surface of the tubular body is formed of a resilient, elastomeric, compressible, and non-porous material having a Shore A durometer hardness of between about 20 and about 65, preferably between about 35 and about 45. The outer surface also has a static coefficient of friction greater than about 50, measured as described below, whereby hair will readily grip the outer surface to facilitate winding hair about the hair roller. Within the above recited range for Short A durometer hardness, the outer surface material is sufficiently compressible to be temporarily indented by the hair under tension and to receive within each indentation a side portion of individual hair shafts to enlarge the area of contact between the surface of the hair roller and the surfaces of individual hair shafts adjacent to the roller surface. Within the above recited range of coefficient of friction, the material of the roller surface is able to hold the hair in place over the enlarged area of contact.

The tubular body may be an integral structure composed of the same material. Alternatively, the inner body may have an inner member formed of a relatively rigid material such as polypropylene or nylon, and an outer sleeve that is positioned around the inner member and defines the outer surface of the tubular body.

The tubular body defines a bore that is open at both ends. Thus, hair clips that are used with the hair roller are receivable on either end of the hair roller. This is particularly advantageous where two hair rollers are next to each other on a person's head in which case one end of each roller is blocked by the other roller. It is also advantageous in that the rollers can be placed on a pin in a heating rack from either end and is therefore time-saving for the operator.

In accordance with a further feature of this invention, the wall of the tubular body is thinner at both ends than along the middle portion. In addition, the outer surface of both ends of the tubular body is knurled. As a result, when the hair roller is heated, the ends remain relatively cool and the knurls minimize finger contact with the hair roller.

Since the outer surface of the hair rollers smooth to the touch, or has only minimal departure from smoothness, the hair rests against a surface that does not leave ripples in the hair. The elastomer surface has a high coefficient of friction and is compressible, so that it is relatively easy to grip the hair on the hair roller to begin winding the hair on the hair roller and maintain tension on the hair.

The hair clips that are receivable on the hair roller include a plurality of fingers that may be provided with teeth at one end. The teeth are receivable in the grooves defined by the knurled end of the hair roller, so that the clip will resist rotation along the hair roller.

BRIEF DESCRIPTION OF THE DRAWINGS

FIG. 1 is an elevational view of the hair roller of the present invention, showing in phantom a clip on the roller;

FIG. 2 is a fragmentary, cross-sectional view of the hair roller and hair clip shown in FIG. 1;

FIG. 3 is a cross-sectional view taken along plane 3—3 in FIG. 1;

FIG. 4 is a cross-sectional view, similar to FIG. 3, and showing another embodiment of the hair roller;

FIG. 5 is a cross-sectional view on a reduced scale of the hair roller of FIG. 1 positioned on a heating element; and FIG. 6 is a plan view of the hair clip shown in FIG. 2.

DESCRIPTION OF THE PREFERRED EMBODIMENTS

While this invention is susceptible of embodiment in many different forms, there is shown in the drawing and described herein in detail preferred embodiments of the invention, with the understanding that the present disclosure is to be considered as an exemplification of the principles of the invention and is not intended to limit the invention to the embodiments illustrated.

Referring to FIGS. 1 and 2, a hair roller 10 is shown on which a hair clip 12 is received. For convenience, the hair clip is shown above the hair roller, but it is generally preferred that the clip be inserted between the scalp and the roller.

The hair roller comprises a tubular body that defines an outer surface for receiving hair to be wound thereon. The hair rollers preferably are made in three different sizes—small, medium and large. All three sizes are the same length, but vary in diameter.

Referring to FIG. 2, the hair roller 10 includes a tubular inner member that comprises a cylindrical body 14 which defines a cylindrical bore 16 extending therethrough so that the cylindrical body is open at both ends. The body 14 is formed of a relatively rigid material, such as polypropylene or nylon. The body 14 has an outer surface 18.

The hair roller 10 also includes an outer sleeve 20 that overlies the cylindrical body 14. The outer sleeve 20 is formed of a resilient, elastomeric, compressible and non-porous material such as silicone rubber that has a Shore A durometer hardness of between about 20 and about 65 and a static co-efficient of friction greater than about 50, at ambient temperature measured against dry hardwood on the James machine in accordance with ANSI/ASTM F 489-77. The material of the cylindrical body 14 preferably has a specific heat greater than 0.3, and a density greater than 0.8, as measured by ASTM D 792. The deflection temperature of the body material, measured by ASTM D 648, is greater than 125° C. at 240 p.s.i., and is greater than 200° C. at 66 p.s.i. The outer sleeve 20 has an outer surface 22 that is free of projections or depressions exceeding 0.010 inches in height or depth and is preferably smooth to the touch.

The outer sleeve 20 has a thickness of at least 0.005 inch and is preferably about 0.030 inches in thickness. Alternatively, the hair roller 10 may comprise an integral structure composed of the same material that is resilient, elastomeric, compressible, and non-porous, and has a Shore A durometer hardness of between about 20 and about 65 and an outer surface having a static coefficient of friction greater than about 50, measured as described above. The material has a specific heat greater than 0.3, and a density greater than 0.8, as measured by ASTM D 792 when high temperature operations are comptemplated.

As will be understood by those skilled in the art, there are a number of commercially available elastomers which may be suitable as the material of construction for the sleeve of the hair roller, or for the entire hair roller if it is of unitary construction. If the hair roller is intended to be used at elevated temperatures, the elastomer must, of course, be resistant to repeated exposure to the heat encountered when the roller is preheated before being applied to the hair. Suitable elastomers for this purpose include silicone elastomers and ethylene-propylene terpolymer elastomers (EPDM).

Suitable silicone elastomers are sold by Dow Corning Corporation under the trademark "Silastic," by Rhodia, Inc., under the trademark "Rhodorsil," and by SWS Silicones Corporation under the trademark "SWS." Suitable EPDM elastomers are sold by B. F. Goodrich Chemical Company under the trademark "Epcar," by Bunawerke Huels GmbH under the trademark "Buna AP" by Copolymer Rubber and Chemical Corporation under the trademark "Epsyn," by DSM Elastomer Sales under the trademark "Keltan," by E. I. DuPont de Nemours and Company under the trademark "Nordel," by International Synthetic Rubber Company under the trademark "Intolan," by Mitsui Petrochemical Industries, Ltd. under the trademark "EPT," by Montedison S.p.A. under the trademark "Dutral," by Sumitomo Chemical Company Ltd. under the trademark "Esprene," and by Uniroyal, Inc. under the trademark "Royalene."

For applications in which temperature resistance is not critical, other elastomers may be used, including styrene-butadiene rubbers (SBR), natural rubber, cis-polybutadiene rubbers, cis-polyisoprene rubbers, butyl rubber, neoprene and nitrile rubbers.

Extruded silicone rubber is a particularly suitable material for the sleeve inasmuch as it has been found in photomicrographs that its outer surface has approximately the same degree of roughness as a hair strand, and the interaction between the surfaces of the sleeve and the hair strand helps to hold the hair strand in place on the sleeve.

Elastomers are commonly compounded with fillers and plasticizers to modify their properties, including hardness and coefficient of friction, or tack. For elastomers which may not, in their natural state, have hardness values and static coefficients of friction within the above defined limits, those skilled in the art of elastomer compounding will know how to incorporate appropriate additives to obtain the desired properties.

Suitable materials for the body portion of the hair roller (when it is not of integral construction) include polypropylene, silicone, and nylon.

Referring to FIGS. 1 and 2, the hair roller 10 includes a central hair receiving portion positioned between a pair of outer shoulders 24. The shoulders 24 are positioned at the ends of the hair roller on opposite sides of the central portion. As depicted in FIG. 2, each shoulder 24 is an outer portion of the body 14 having an outer diameter greater than the outer diameter of the central portion of the body. An abutment 23 provides a transition on the outer surface of the body between the shoulders 24 and the reduced diameter central portion. The outer surface of the shoulders 24 preferably is knurled, as shown in FIG. 1, to define a plurality of teeth 25 (FIG. 3) that are separated by grooves.

The outer sleeve 20 is positioned on the body 14 between the abutments 23 on the shoulders 24 to define the central hair receiving portion of the hair roller.

Since the outer sleeve 20 is formed of an elastomeric material, it is stretchable. To secure the sleeve 20 to the body 14, the sleeve 20 is stretched to increase its inner diameter until it exceeds the outer diameter of the shoulder 24. The stretched sleeve 20 is then moved axially until it overlies the central portion of the body 14. The sleeve 20 is then released, whereby its inherent bias causes the sleeve 20 to contract until it engages the outer surface 18 of the body 14. The unrestrained inner diameter of the sleeve 20 is less than the outside diameter of the outer surface 18 of the body 14 between the shoulders 24. The sleeve 20 is therefore in tension while it engages the outer surface 18 of the body, and the tension in the sleeve 20 maintains it in position on the body 14. The abutments 23 on the shoulders 24 prevent the sleeve 20 from moving axially along the outer surface 18 of the body. The sleeve 20 preferably has a length about equal to the distance between the abutments 23 on the shoulders 24.

Alternatively, the outer sleeve 20 can be formed by spraying or brushing an elastomeric material on to the outer surface of the body or dipping the body into a bath of the elastomeric material.

Referring to FIG. 2, the central portion of the body 14 includes a pair of opposing end portions 26 positioned inwardly of the shoulders 24. Referring to the bore 16 shown in FIG. 2, the inside diameter of each shoulder 24 is greater than the inside diameter of each end portion 26, and the inside diameter of the end portion 26 is greater than the inside diameter of the remainder of the central portion of the body 14.

A shoulder or abutment 28 is defined between the reduced diameter central portion of the body 14 and the outer end 26 of the central portion which has a greater diameter. The abutment 28 is transverse to the axis of the body 14.

The bore 16 is tapered inwardly between the abutments 28, with the inside diameter being greater adjacent to the abutments 28 than at the midpoint of the central portion of the body 14. The outside surface 18 of the central portion of the body 14 is also tapered inwardly and defines a generally concave outer surface, with the ends of the outside surface 18 of the central portion having a predetermined outer diameter and the midpoint having a lesser outer diameter.

The outer surface 22 of the hair roller 10 is formed of a material having a Shore durometer A hardness of between about 20 and about 65, preferably between about 35 and about 45. The material forming the outer surface has a high static coefficient of friction so that the hair will be readily gripped on the outer surface 22 and will not slip as the hair roller is turned. The static coefficient of friction for elastomeric materials is difficult to measure reproducibly because of the yieldability of elastomeric materials under pressure. However, a suitable standardized test has been devised for shoe sole and heel materials by the American National Standard Institute and the American Society For Testing Materials utilizing a machine, called the James machine, invented for the purpose. The test is published under the designation ANSI/ASTM F 489-77. A suitable level for static coefficient of friction for the outher surface of the roller by the foregoing test is greater than about 50, as measured at ambient temperature against dry hardwood. Hardwood, of course, is not related to the use of the outer surface material in accordance with this invention. It is, however, convenient for testing purposes because it is a material relevant to the use of shoe sole and heel materials for which the foregoing test was designed.

Since the hair is frequently wetted with desirable solutions, the outer surface material is non-porous so that it will not wick the solution away from the hair which would result in uneven distribution of solution on the hair. The outer surface 22 is smooth to the vision and to the touch, having a maximum displacement from peak to valley of 0.020 inches, since a more deeply textured surface would result in the undesirable wicking of solution from the hair by capillary action. Projections having a maximum displacement of no more than 0.010 inches from the outer surface assist in gripping and holding the hair on the outer surface 22 of the hair roller, without leaving marks in the hair.

In use, a person grasps a lock of hair, and places the ends of the hair on the outer surface 22 of one of the hair rollers 10. The hair, pressed against the compressible, elastomeric surface, forms a temporary indentation therein to enlarge the area of contact between the hair and the roller surface, and the high coefficient of friction, acting through an enlarged area of contact, holds the hair in place during the winding operation. The hair roller 10 is then rolled about its axis which causes the hair to wind about the roller.

If desired, a person can wind only the ends of the strands of hair about the roller. Instead, the user can wind virtually the entire length of the hair about the roller by turning the roller until it approaches the scalp of the head. Alternatively, the user can hold the roller adjacent to the scalp, grasp the hair, and wind the hair about the roller without turning the roller.

After the hair is wound about the roller to the desired extent, a clip 12 is secured to the hair roller 10 to maintain the hair in position on the hair roller between the outer surface 22 of the hair roller and the clip 12.

The inside surface 30 of the end portions 26 of the body 14 are generally smooth and flat and concentric with the axis of the bore 16, as shown in FIG. 2. The inside surface 30 terminates at one end in the abutment 28. The other end of the inside surface 30 terminates in a wall 32 that separates the end portion 26 from the shoulder 24, the shoulder having a greater inside diameter than the end portion 26. The inside surface 34 of the shoulder 24 is also generally smooth and flat and concentric with the axis of the bore 16 and the inside surface 30 of the end portion 26.

In cross-section, the thickness of the end portion 26 between the inside surface 30 and the outer surface 18 is less than the thickness of the remainder of the central portion of the body 14, and greater than the thickness of the shoulder 24. The shoulder 24 preferably is relatively thin-walled so that it will rapidly cool, as described hereinbelow.

After winding, hair is retained in place on the hair roller 10 by means of the clips 12. Referring to FIGS. 2 and 6, each of the clips 12 has a handle 40 with a plurality of elongated generally cylindrical fingers 42 that extend outwardly from the handle. Four fingers 42 are shown in FIG. 6. The fingers 42 preferably have a length about equal to the length of the hair roller 10. Since the shoulders 24 of the hair roller have an outside diameter greater than the outside diameter of the central portion of the hair roller, the fingers 42 overlie the shoulders 24 and are spaced from the outer surface 22 of the sleeve 20, as depicted in FIGS. 1 and 2. The hair is thus positioned between the outer surface 22 of the sleeve 20 and the fingers 42 of the clip 12.

To retain the clip 12 on the hair roller 10, the clip is further provided with a downwardly and inwardly extending arm 44 as shown in FIG. 2. The arm 44 has a downwardly extending leg 46 having one end secured to the handle 40 of the clip 12. The arm 44 also includes another leg 48 that has one end secured to the opposite end of the leg 46. Leg 48 extends inwardly, generally parallel to the fingers 42 but spaced therefrom. The arm 44 is resilient, and is inherently biased to a position where the leg 48 is relatively close to the fingers 42, with the arm being movable to a second position in which the leg 48 is further from the fingers 42. The length of the arm is about equal to the combined length of the shoulder 24 and the end portion 26.

Once the hair is wound about the hair roller 10, the clip 12 is applied to the hair roller. This is accomplished by first positioning the clip 12 with the fingers pointed generally upwardly, transverse to the axis of the hair roller, with the distal end of the leg 48 engaging the inside surface 34 of the shoulder 24.

Pressure is applied to the clip as it is pushed inwardly into the bore 16 and rotated slightly until the fingers 42 are generally parallel to the axis of the hair roller 10. As the clip is rotated, the distal end of the leg 48 is moved inwardly along the inside surface 34 of the shoulder 24, rides along wall 32, and then engages and slides along the inside surface 30 of the end portion 26. The clip 12 is pushed inwardly until the clip engages the end of shoulder 24 that is closest to the handle 40, or until the digital end of the arm 44 engages the abutment 28.

When fully received on the hair roller 10, the clip 12 assumes the position shown in FIGS. 1 and 2. In this position, there is tension in the arm 44 since it has been pushed outwardly to the second position in which the leg 48 is relatively further from the fingers 42. The tension in the arm 44 is a force that helps to retain the clip 12 in position on the hair roller 10.

The clip 12 preferably is integrally formed of a plastic material, such as the polyacetal resin sold under the trademark "Delrin," having sufficient resiliency for the arm 44.

The end of the fingers 42 that is furthest from the handle 40 may be provided with downwardly extending teeth 50 (FIGS. 2, 3 and 6) that are receivable in the grooves between the teeth 25 in the knurled shoulder 24 of the hair roller. As shown in FIG. 3, the teeth 50 are receivable in the grooves between the teeth 25 so that the fingers 42 will remain in position on the hair roller 10 and will resist rotation. This enables a person to maintain the hair tightly wound on the hair roller. If desired, sufficient force could be applied to the fingers 42 for the purpose of moving the fingers 42 along the knurled shoulder 24 to adjust the tension of the hair. In the illustrated embodiment, only the two middle fingers 42 are provided with teeth 50, but any number of these fingers may be provided with the teeth.

The clips 12 preferably have four fingers 42, as shown in FIG. 6. The four fingers enable the same clips to be used with a relatively great range of sizes of hair rollers. Thus, the two inner fingers are adapted to hold the small size rollers, with the teeth 50 being received in the grooves on the shoulders 24 of the roller. The two outermost fingers are adapted to hold the clip on the medium and large size rollers.

Each of the fingers 42 has a stand off segment 49 adjacent to the handle 40 of the lip, as shown in FIG. 2. The stand off segment 49 overlies one of the shoulders 24 of the roller, is slightly offset from the remainder of the fingers 42, and extends generally parallel to the remainder of the fingers. The axis of the stand off segment 49 is farther from the arm 44 of the clip than the axis of the remainder of the fingers 42. The stand off segment 49 is advantageous in that it spaces the shoulder 24 and the body portion 14 of the heated roller away from the user's scalp to thereby lessen the amount of heat that the scalp is subjected to.

It is a feature of the present invention that both ends of the hair roller 10 are substantially identical. As a result, a person can insert the clip 12 into either end of the hair roller. This is particularly advantageous where two hair rollers are positioned next to each other on a person's head. In this instance, one end of each roller is covered by the adjacent roller, but the clip 12 can be inserted ino the opposite end of each roller which remains open.

As shown in FIG. 5, a rack 52 is provided for heating the hair rollers 10 before they are used on the hair. The rack 52 includes a flat plate 54 having a plurality of heat conducting spindles 56 extending upwardly from the plate. The spindle 56 includes an enlarged diameter base portion 58 and a reduced diameter pin 60 extending upwardly from the base 58. A shoulder 62 is defined between the base 58 and the pin 60. The hair rollers 10 are placed on the rack 52 by moving either end of the hair roller toward the rack until the pin 60 is positioned in the bore 16.

The outside diameter of the base 58 is smaller than the inside diameter 30 of the end portion 26 of the hair roller and is also smaller than the inside diameter 34 of the shoulder 24. The pin 60 is tapered and has an outside diameter slightly smaller than the inside diameter of the remainder of the central portion of the body 14 of the hair roller. It is desired that the remainder of the central portion of the body 14 fit snugly on the pin 60.

The height of the base 58 is slightly greater than the combined length of one of the shoulders 24 and end portions 26 of the hair roller 10. When the hair roller is positioned on the spindle 56, the abutment 28 on the hair roller engages the shoulder 62 at the top of the base 58 of the spindle, and the hair roller is spaced above the plate 54. The gap between the hair roller and the plate 54, and the space between the base 58 of the spingle and the shoulder 24 and end portion 26 of the hair roller, prevent the shoulder 24 from becoming too hot. The relatively thin wall along the shoulder 24, and the knurled outside surface of the shoulder, also helps to prevent the shoulder 24 from becoming too hot for a person to touch.

In the preferred embodiment, the central portion of the body 14 completely circumscribes the bore 16 to define a cylindrical opening, as shown in FIG. 3. In the alternate embodiment shown in FIG. 4, the central portion of the body between abutments 28 comprises a plurality of axially extending arcuate segments 70 which are spaced apart from one another along the circumference of the body for the purpose of minimizing the amount of material required to form the hair roller. Referring to FIG. 4, each of the segments 70 has a concave inner surface 72 defining the central bore that extends through the hair roller. The segments 70 each include a pair of side walls 74, with the side walls of adjacent segments being spaced from one another.

From the foregoing, it will be observed that numerous variations and modifications may be effected without departing from the true spirit and scope of this invention. It is to be understood that no limitation with respect to the specific apparatus illustrated and described herein is intended or should be inferred. It is, of course, intended to be covered by the appended claims all such modifications as fall within the scope of the claims.

What is claimed is:

1. A hair roller comprising a tubular body defining an outer surface for receiving hair to be wound thereon, said outer surface being free of projections or depressions exceeding 0.010 inches in height or depth and being formed of a resilient, elastomeric, compressible, and non-porous silicone elastomer material having a Shore durometer A hardness of between about 20 and about 65 and said outer surface having a static coefficient of friction greater than about 50, measured at ambient temperature against dry hardwood on the James machine in accordance with ANSI/ASTM F 489-77, whereby hair will readily grip said outer surface to facilitate winding hair about said hair roller, said tubular body being open at both ends and having a central hair receiving portion and an outer shoulder at each end of said body on opposite sides of said central position, each of said shoulders having an outer diameter greater than the outer diameter of said central portion, each of said shoulders having an outside surface adapted to receive clip means for retaining the hair on the central hair receiving portion of the tubular body, wherein said clip means includes a handle and a plurality of fingers extending outwardly from said handle, said fingers being adapted to overlie said hair roller, said clip further having an arm extending outwardly from said handle and adapted to be received in said tubular body, each of said fingers having a stand off segment adjacent to said arm, said stand off segment being generally parallel to the remainder of said fingers and offset from the axis of each finger, the axis of said stand off segment being farther from said arm than the axis of the remainder of said fingers.

2. A hair roller as defined in claim 1 wherein said clip means has four fingers comprising two inner fingers and two outer fingers, said two inner fingers each being provided with downwardly extending teeth adapted to engage one of said outer shoulders.

* * * * *